US011261881B2

(12) United States Patent
Hwang et al.

(10) Patent No.: US 11,261,881 B2
(45) Date of Patent: Mar. 1, 2022

(54) SUCTION UNIT

(71) Applicant: LG Electronics Inc., Seoul (KR)

(72) Inventors: Mantae Hwang, Seoul (KR); Jungbae Hwang, Seoul (KR); Dongseok Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 52 days.

(21) Appl. No.: 15/756,674

(22) PCT Filed: Aug. 31, 2016

(86) PCT No.: PCT/KR2016/009742
§ 371 (c)(1),
(2) Date: Mar. 1, 2018

(87) PCT Pub. No.: WO2017/039330
PCT Pub. Date: Mar. 9, 2017

(65) Prior Publication Data

US 2018/0252238 A1 Sep. 6, 2018

(30) Foreign Application Priority Data

Sep. 3, 2015 (KR) ..... 10-2015-0124886

(51) Int. Cl.
*F04D 29/66* (2006.01)
*A47L 9/22* (2006.01)
(Continued)

(52) U.S. Cl.
CPC ..... *F04D 29/667* (2013.01); *A47L 5/22* (2013.01); *A47L 9/0081* (2013.01); *A47L 9/22* (2013.01);
(Continued)

(58) Field of Classification Search
CPC .... F04D 29/661; F04D 29/663; F04D 29/441; F04D 29/703; F04D 29/263;
(Continued)

(56) References Cited

U.S. PATENT DOCUMENTS 2,135,036 A * 11/1938 Karlstrom ..... A47L 9/104 55/317
4,111,615 A * 9/1978 Watanabe ..... A47L 5/22 415/119
(Continued)

FOREIGN PATENT DOCUMENTS

CN 1187589 7/1998
JP H02009998 1/1990
(Continued)

OTHER PUBLICATIONS

Extended European Search Report in European Appln. No. 16842296.2, dated Mar. 21, 2019, 7 pages.
(Continued)

*Primary Examiner* — Michael Lebentritt
*Assistant Examiner* — Jason G Davis
(74) *Attorney, Agent, or Firm* — Fish & Richardson P.C.

(57) ABSTRACT

The suction unit comprises: a cover having an air inlet; a noise reduction part provided in the cover, arranged outside the air inlet and spaced therefrom; an impeller for flowing the air which has passed through the noise reduction part and then the air inlet; a motor having a rotating shaft connected to the impeller; a guide apparatus for guiding the flow of the air which has flown from the exit of the impeller; and a shaft coupling part coupled to the rotating shaft connected to the impeller.

19 Claims, 7 Drawing Sheets

(51) Int. Cl.

| | |
|---|---|
| ***A47L 9/00*** | (2006.01) |
| ***A47L 5/22*** | (2006.01) |
| ***F04D 25/06*** | (2006.01) |
| ***F04D 29/42*** | (2006.01) |

(52) U.S. Cl.
CPC ..... *F04D 25/06* (2013.01); *F04D 29/4206* (2013.01)

(58) Field of Classification Search
CPC ..... F04D 29/626; F04D 29/4206; F04D 29/4213; F04D 29/667; F04D 415/119; F04D 415/185; F04D 415/191; F05B 2260/96; F05D 2260/96; A47L 5/22; A47L 9/0081; A47L 9/22
See application file for complete search history.

(56) References Cited

U.S. PATENT DOCUMENTS

| | | | | |
|---|---|---|---|---|
| 4,708,585 | A * | 11/1987 | Fukazawa | F04D 29/225 415/218.1 |
| 4,767,285 | A * | 8/1988 | Jyoraku | F04D 25/06 417/366 |
| 5,259,726 | A * | 11/1993 | Bacria | F04D 29/703 415/119 |
| 5,343,831 | A * | 9/1994 | Collins | F01P 5/06 123/198 E |
| 5,984,632 | A | 11/1999 | Lee et al. | |
| 6,232,696 | B1 * | 5/2001 | Kim | F04D 25/0653 310/156.37 |
| 6,264,427 | B1 * | 7/2001 | Berfield | A47L 5/22 415/108 |
| 6,719,541 | B2 * | 4/2004 | Bundy | A47L 5/22 417/366 |
| 7,291,192 | B1 * | 11/2007 | Lavasser | A47L 5/22 55/406 |
| 7,866,944 | B2 * | 1/2011 | Kenyon | F04D 17/16 415/199.2 |
| 8,231,335 | B2 * | 7/2012 | Barker | F04D 29/703 361/679.48 |
| 9,089,248 | B2 * | 7/2015 | Yoo | A47L 5/22 |
| 9,835,176 | B2 * | 12/2017 | Hustvedt | F04D 29/665 |
| 2012/0141262 | A1 * | 6/2012 | Kim | F04D 29/4226 415/204 |
| 2014/0294578 | A1 * | 10/2014 | Oh | F04D 29/4206 415/208.1 |
| 2015/0337856 | A1 * | 11/2015 | Hwang | F04D 29/441 415/174.3 |
| 2016/0369819 | A1 * | 12/2016 | Lofy | F04D 29/4213 |
| 2017/0051755 | A1 * | 2/2017 | Liu | A47L 5/22 |
| 2018/0180050 | A1 * | 6/2018 | Hayamitsu | F04D 17/06 |

FOREIGN PATENT DOCUMENTS

| | | |
|---|---|---|
| JP | H11099097 | 4/1999 |
| JP | 2004251151 | 9/2004 |
| JP | 2011052580 | 3/2011 |
| JP | 2011122538 | 6/2011 |
| JP | 2013053527 | 3/2013 |
| KR | 2019990010220 | 3/1999 |
| KR | 20040106934 | 12/2004 |
| KR | 100501996 | 7/2005 |
| KR | 100700551 | 3/2007 |
| KR | 20130091841 | 8/2013 |
| KR | 1020130091841 | 8/2013 |

OTHER PUBLICATIONS

International Search Report in International Application No. PCT/KR2016/009742, dated Jan. 6, 2017, 2 pages (with partial English translation).

* cited by examiner

SUCTION UNIT

CROSS-REFERENCE TO RELATED APPLICATIONS

This application is a National Stage application under 35 U.S.C. § 371 of International Application No. PCT/KR2016/009742, filed Aug. 31, 2016, which claims the benefit of Korean Application No. 10-2015-0124886, filed on Sep. 3, 2015. The disclosures of the prior applications are incorporated by reference in their entirety.

TECHNICAL FIELD

The present invention relates to a suction unit.

BACKGROUND ART

A vacuum suction unit is generally provided in an electric cleaner and used to suction air containing dust.

A vacuum suction unit is disclosed in Korean Patent Publication No. 2013-0091841 (Published on Aug. 20, 2013) that is a prior art document.

The vacuum suction unit includes a motor, an impeller connected to the motor by a rotating shaft and rotating to suction air, and a guide member disposed adjacent to the impeller to guide the air discharged from the impeller.

An upper end of the rotating shaft is coupled to the impeller. Here, the rotating shaft may be coupled to the impeller by using an adhesive.

According to the prior art document, when the rotating shaft is incompletely coupled to the impeller, or the adhesion between the impeller and the rotating shaft is reduced, the impeller may be pulled out of the rotating shaft, or the rotating shaft runs idle with respect to the impeller.

Also, in the case of the prior art document, as air is introduced through a single suction hole of a fan cover, the air does not flow through the suction hole as a whole and thus flows through only a portion of an area, thereby generating flow noise.

Also, in the case of the prior art document, where the rotating shaft is inserted into the guide member and moves in a direction crossing the rotating shaft in a hole through which the rotating shaft passes, the rotating shaft may cause the impeller to contact the fan cover.

DISCLOSURE OF THE INVENTION

Technical Problem

The present invention provides a suction unit which prevents an impeller from being separated from a rotating shaft.

The prevent invention provides a suction unit which prevents an impeller from running idle with respect to a rotating shaft.

The prevent invention provides a suction unit in which flow noise is reduced while air flows.

The prevent invention provides a suction unit which prevents the impeller from coming into contact with a cover.

Technical Solution

A suction unit according to one aspect includes: a cover provided with an air inlet; a noise reduction part provided on the cover and disposed outside the air inlet so as to spaced apart from the air inlet; an impeller allowing air passing through the air inlet via the noise reduction part to flow; a motor provided with a rotating shaft connected to the impeller; a guide mechanism guiding the air discharged from an outlet of the impeller; and a shaft coupling part coupled to the rotating shaft connected to the impeller.

The noise reduction part may be connected to the air inlet by a connection rib.

An air flow path may be formed between the noise reduction part and the air inlet.

The noise reduction part may allow air flow to be divided into a plurality of flow paths.

The noise reduction part may have an outer diameter less than an inner diameter of the air inlet.

The noise reduction part may include: a first rib having a ring shape; a second rib disposed inside the first rib; and a third rib connecting the first rib to the second rib.

The air may flow between the first rib and the second rib.

The second rib may have the ring shape through which the air passes.

The impeller may include: a shaft through-part through which the rotating shaft passes; and an accommodation part in which the shaft coupling part is accommodated.

The rotating shaft may include a coupling end to which the shaft coupling part is coupled, and the coupling end may be disposed in the accommodation part in a state of passing through the shaft coupling part.

The coupling end may include a screw thread, and the shaft coupling part may include a screw thread to which the screw thread of the coupling end is coupled.

The shaft coupling part may be spaced apart from an inlet of the accommodation part toward the rotating shaft in the state in which the shaft coupling part is coupled to the rotating shaft in the accommodation part.

The accommodation part may have an inner diameter greater than that of the shaft through-part, and the shaft coupling part may come into contact with a stepped surface between the accommodation part and the shaft through-part in the state in which the shaft coupling part is coupled to the rotating shaft.

The rotating shaft may pass through the guide mechanism, and a bearing through which the rotating shaft passes may be disposed on the guide mechanism.

The rotating shaft may be connected to the impeller after passing through the bearing.

The impeller may include a hub and a plurality of blades disposed on the hub, and the guide mechanism may include a guide body and a plurality of vanes disposed to be spaced apart from each other in a circumferential direction on an outer circumferential surface of the guide body.

The hub may have a maximum diameter greater than an outer diameter of the guide body.

Advantageous Effects

According to the proposed invention, since a shaft coupling part of the rotating shaft is connected to the impeller, the impeller may be prevented from being separated from the rotating shaft of the motor.

Also, the impeller may be prevented from running idle with respect to the rotating shaft by the shaft coupling part.

Also, according to the present invention, the flow noise generated while the air is introduced into the air inlet may be reduced by the noise reduction part.

Also, according to the present invention, since the rotating shaft is coupled to the impeller in the state in which the bearing is coupled to the rotating shaft, the movement of the rotating shaft may be restricted in the direction crossing the extension direction of the rotating shaft, and friction noise due to the contact between the impeller and the cover may be reduced.

MODE FOR CARRYING OUT THE INVENTION

Figure 1:
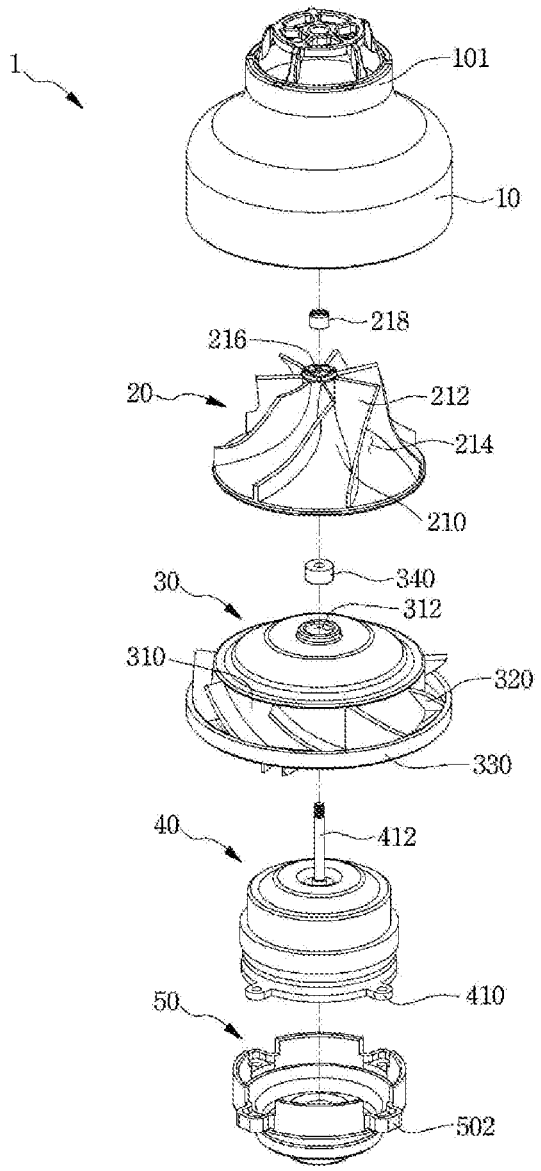
FIG. 1 is an exploded perspective view of a suction unit according to an embodiment of the present invention.

Hereinafter, embodiments of the present invention will be described in detail with reference to the accompanying drawings. It is noted that the same or similar components in the drawings are designated by the same reference numerals as far as possible even if they are shown in different drawings. In the following description of the present invention, a detailed description of known functions and configurations incorporated herein will be omitted to avoid making the subject matter of the present invention unclear.

In the description of the elements of the present invention, the terms first, second, A, B, (a), and (b) may be used. However, since the terms are used only to distinguish an element from another, the essence, sequence, and order of the elements are not limited by them. When it is described that an element is "coupled to", "engaged with", or "connected to" another element, it should be understood that the element may be directly coupled or connected to the other element but still another element may be "coupled to", "engaged with", or "connected to" the other element between them.

FIG. 1 is an exploded perspective view of a suction unit according to an embodiment of the present invention.

Referring to FIG. 1, a suction unit 1 according to an embodiment of the present invention may include a cover 10 provided with an air inlet 101.

Also, the suction unit 1 may further include an impeller 20 and a motor 40 for rotating the impeller 20.

The motor 40 may include a rotating shaft 412, and the rotating shaft 412 may be coupled to the impeller 20.

Although not limited, the motor 40 may include a stator and a rotor, and the rotating shaft 412 may be connected to the rotor.

The impeller 20 may be accommodated in the cover 10. The cover 10 may guide air introduced through the air inlet 101 toward the impeller 20. Also, the cover 10 may separate an internal space from an external atmospheric pressure to maintain a vacuum pressure.

The impeller 20 increases static energy and dynamic energy of the air introduced through the air inlet 101. Thus, a flow rate of the air may increase by the impeller 20.

The impeller 20 may include, for example, a hub 210 and a plurality of impeller blades 212 disposed on the hub 210.

The impeller 20 may further include an accommodation part 216 in which at least a portion of the rotating shaft 412 of the motor 40 is accommodated.

At least a portion of the rotating shaft 412 may be disposed in the accommodation part, and the rotating shaft 412 disposed in the accommodation part 216 may be coupled to the shaft coupling part 218.

The suction unit 1 may further include a guide mechanism 30 guiding the air discharged from an outlet 214 of the impeller 20.

The guide mechanism 30 serves to convert the dynamic energy of energy components of the air discharged from the outlet 214 of the impeller 20 into the static energy. That is, the guide mechanism 30 may reduce a flow rate of a fluid to increase the static energy.

The guide mechanism 30 may be coupled to the cover 10.

Also, at least a portion of the guide mechanism 30 may be disposed within the cover 10, and the impeller 20 may be disposed above the guide mechanism 30.

The guide mechanism 30 may include a guide body 310 and a plurality of vanes 320 disposed around the guide body 310.

For example, the guide body 310 may have a cylindrical shape, and the plurality of guide vanes 320 may be spaced apart from each other in a circumferential direction of the guide body 310.

Here, the hub 210 may have a maximum diameter greater than an outer diameter of the guide body 310.

The guide mechanism 30 may further include a connection part 330 connecting the plurality of guide vanes 320 to each other. One side of the cover 10 may be seated on the connection part 330.

The guide mechanism 30 may further include a bearing 340. The rotating shaft 412 may pass through the bearing 340 and than be coupled to the impeller 20.

The suction unit 1 may further include a motor supporter 50 for supporting the motor 40.

The motor 40 may include a first coupling part 410 coupled to the motor supporter 50, and the motor supporter 50 may include a second coupling part 502 coupled to the first coupling part 410.

An air flow in the suction unit 1 will be simply described.

When power is applied to the suction unit 1, the motor 40 is driven. As a result, the rotating shaft 412 rotates, and thus, the impeller coupled to the rotating shaft 412 rotates.

External air of the suction unit 1 is introduced into the cover 10 through the air inlet 101 by the impeller 20. The air introduced into the cover 10 flows along the impeller 20.

The air discharged from the outlet 214 of the impeller 20 is guided by the cover 10 to flow toward the guide vanes 320 of the guide mechanism 30. Then, the air flows between an outer circumferential surface of the guide body 310 and an inner circumferential surface of the cover 10. In this process, the guide vanes 320 guide the air flow.

Also, the air guided by the guide vanes 320 may flow along an outer circumferential surface of the motor supporter 50.

Figure 2:
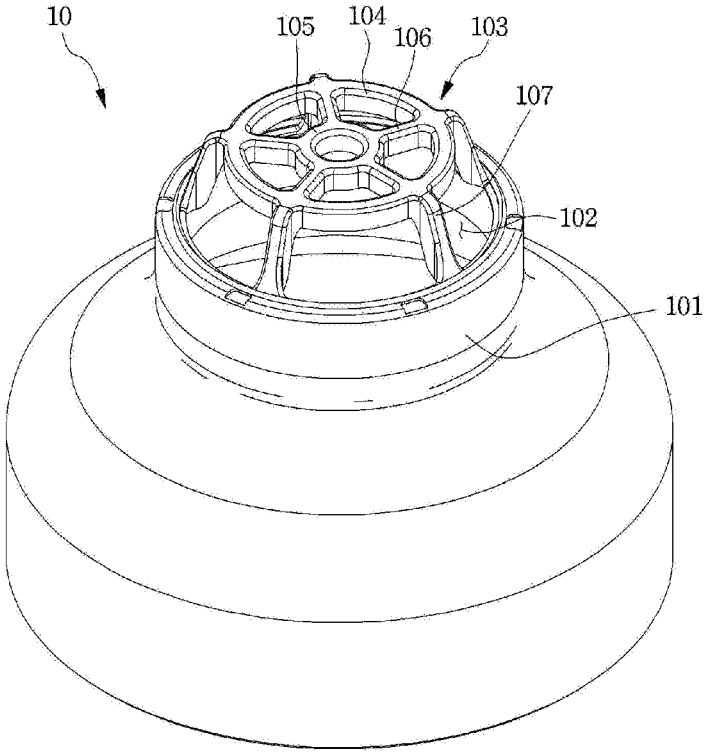
FIG. 2 is a perspective view of a cover of the suction unit of FIG. 1.

FIG. 2 is a perspective view of the cover of the suction unit of FIG. 1.

Referring to FIG. 2, the cover 10 according to this embodiment may further include a noise reduction part 103 for reducing noise generated while the air is introduced into the air inlet 101.

The noise reduction part 103 may be disposed at an upstream side of the air inlet 101 with respect to the flow direction of the air.

The noise reduction part 103 may guide the air so that the air is divided into a plurality of air flow paths 102, thereby reducing the noise.

The noise reduction part 103 may be disposed outside the air inlet 101 so as to be spaced apart from the air inlet 101 and be connected to the air inlet 101 by a connection rib 107.

Thus, the air may be introduced into the air inlet 101 through a gap between the noise reduction part 103 and the air inlet 101.

Also, the air may flow to be divided by the noise reduction part 103.

The noise reduction part 103 may include a first rib 104 having a ring shape, a second rib 105 disposed inside the first rib 104, and a third rib 106 connecting the first rib 104 to the second rib 105.

The first rib 104 may have an outer diameter less than a diameter of the air inlet 101.

The second rib 105 may have a ring shape. Thus, the air may pass through the second rib 105.

Since the second rib 105 is disposed inside the first rib 104, the air may flow between the first rib 104 and the second rib 105. Here, the air may flow to be partitioned by the third rib 106 between the first rib 104 and the second rib 105.

Thus, according to this embodiment, when the motor 40 is driven to rotate the impeller 20, a portion of air outside the suction unit 1 may be introduced into the air inlet 101 via a space between the noise reduction part 103 and the air inlet 101. Another portion of the air may be introduced into the air inlet 101 via a region defined by the second rib 105, and further another portion of the air may be introduced into the air inlet 101 via a region between the first rib 104 and the second rib 105.

According to this embodiment, since the air outside the air inlet 101 flows through the plurality of flow paths partitioned by the noise reduction part 103 and then is introduced into the air inlet 101, turbulence formation of the air may be minimized, and thus, the flow noise of the air may be reduced.

Here, since the noise reduction part 103 is disposed outside the air inlet 101, reduction of a flow path area within the air inlet 101 may be prevented to prevent a flow amount of air from being reduced.

Figure 3:
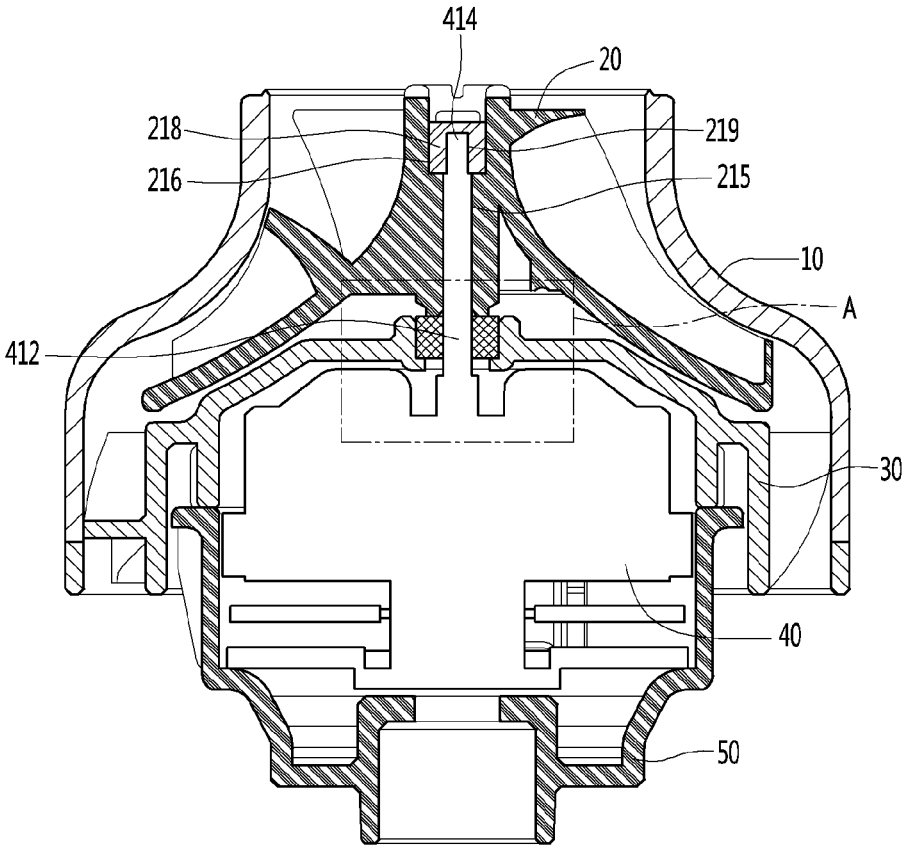
FIG. 3 is a cross-sectional view of the suction unit according to an embodiment of the present invention.
Figure 4:
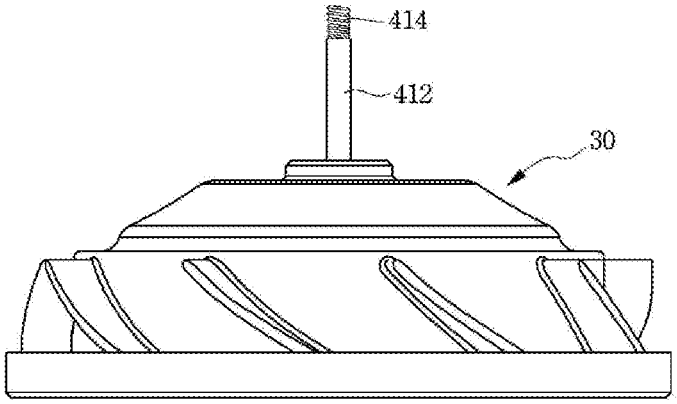
FIG. 4 is a view illustrating a state in which a rotating shaft of a motor passes through a guide mechanism according to the present invention.
Figure 5:
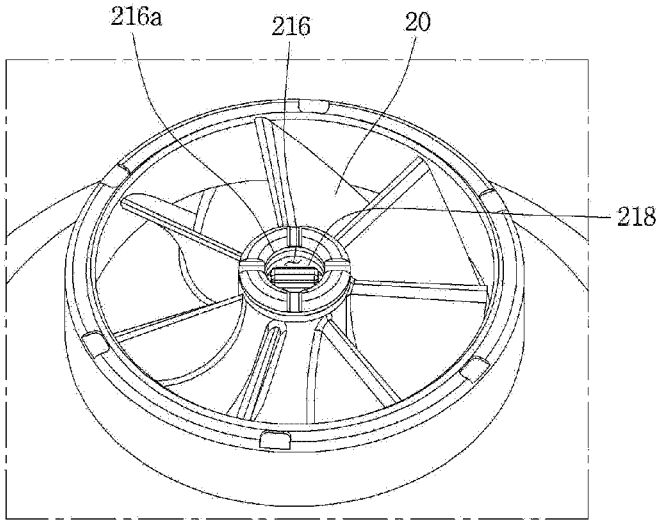
FIG. 5 is a view of a shaft coupling part coupled to the rotating shaft in an impeller.

FIG. 3 is a cross-sectional view of the suction unit according to an embodiment of the present invention, FIG. 4 is a view illustrating a state in which the rotating shaft of the motor passes through the guide mechanism according to the present invention, and FIG. 5 is a view of the shaft coupling part coupled to the rotating shaft in the impeller.

Referring to FIGS. 3 to 5, the rotating shaft 412 of the motor 40 passes through the guide mechanism 30 and then is coupled to the impeller 20.

For example, the impeller 20 may further include a shaft through-part 215 through which the rotating shaft 412 of the motor 40 passes. The shaft through-part 215 may communicate with the accommodation part 216.

The rotating shaft 412 may pass through the shaft through-part 215, and a portion of the rotating shaft 412 may be disposed in the accommodation part 216.

The rotating shaft 412 may pass through the shaft through-part 215 at a lower side of the impeller 20 with reference to the drawings.

The accommodation part 216 may have a diameter greater than that of the shaft through-part 215. For example, the shaft through-part 215 may have a diameter that is equal to or less somewhat than an outer diameter of the rotating shaft 412. Thus, the rotating shaft 412 may be press-fitted into the shaft through-part 215. In this case, a separate fixing unit for coupling the rotating shaft 412 to the impeller 20 is unnecessary. Alternatively, the rotating shaft 412 may adhere to the impeller 20 through an adhesive.

In the state in which a portion of the rotating shaft 412 is disposed in the accommodation part 216, an outer circumferential surface of the rotating shaft 412 is spaced apart from an inner circumferential surface of the accommodation part 216.

Also, in the state in which the rotating shaft 412 is disposed in the accommodation part 216, an end of the rotating shaft 412 is spaced apart from an opening **216*a* of the accommodation part 216**.

The rotating shaft 412 may include a coupling end 414 coupled to the shaft coupling part 218.

When the rotating shaft 412 passes through the shaft through-part 215, the coupling end 414 of the rotating shaft 412 is disposed in the accommodation part 216.

The coupling end 414 may have an outer diameter less than that of the rotating shaft 412, but is not limited thereto.

A screw thread coupled to the shaft coupling part 218 may be formed on an outer circumferential surface of the coupling end 414. The shaft coupling part 218 may include an accommodation groove 219 for accommodating the coupling end 414, and a screw thread may be formed on an inner circumferential surface of the accommodation groove 219.

In the state in which the coupling end 414 of the rotating shaft 412 is disposed in the accommodation part 216, the shaft coupling part 218 may be accommodated in the accommodation part 216 through the opening **216*a* and be coupled to the coupling end 414 in the accommodation part 216**.

In the state in which the shaft coupling part 218 is coupled to the coupling end 414 of the rotating shaft 412, the shaft coupling part 218 is disposed within the accommodation part 216. That is, the shaft coupling part 218 is disposed to be spaced apart from the inlet **216*a* of the accommodation part 216**.

A portion of the inner diameter of the accommodation part 216 may be less than an outer diameter of the shaft coupling part 218. Thus, the shaft coupling part 218 may be press-fitted into the accommodation part 216.

According to this embodiment, since the shaft coupling part 218 is coupled to the coupling end 414 of the rotating shaft 412, the impeller 20 may be prevented from being separated from the rotating shaft 412.

Also, since the shaft coupling part 218 is press-fitted into the accommodation part 216, the rotating shaft 412 may be prevented from running idle with respect to the impeller 20.

Here, in the state in which the shaft coupling part 218 is coupled to the coupling end 414 of the rotating shaft 412, the shaft coupling part 218 may come into contact with a stepped surface between the accommodation part 216 and the shaft through-part 215 to press the stepped surface. In this case, even if the shaft coupling part 218 is not press-fitted into the accommodation part 216, the idling of the rotating shaft 412 with respect to the impeller 20 may be prevented by friction force between the stepped surface and the shaft coupling part 218.

Alternatively, the shaft coupling part 218 is press-fitted into the accommodation part 216, and the shaft coupling part 218 may press the stepped surface between the accommodation part 216 and the shaft through-part 215.

Figure 6:
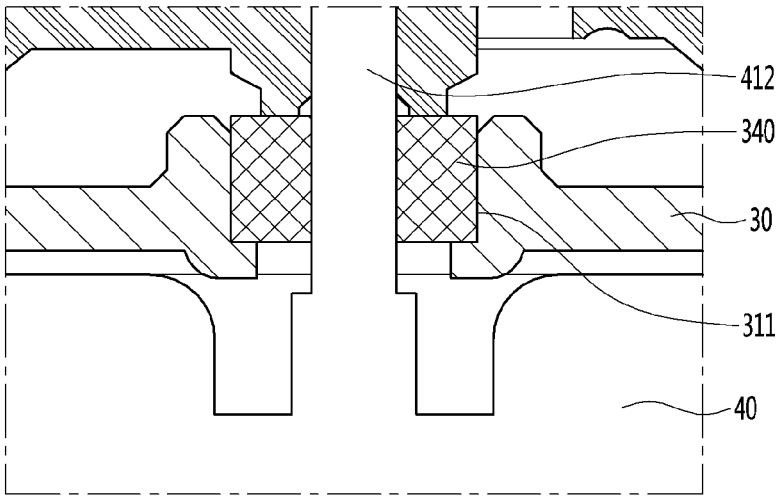
FIG. 6 is an enlarged perspective view of a portion A of FIG. 3.

FIG. 6 is an enlarged perspective view of a portion A of FIG. 3.

Referring to FIG. 6, the guide mechanism 30 according to this embodiment may further include a bearing 340 to which the rotating shaft 412 of the motor is coupled.

The bearing 340 may guide rotation of the rotating shaft 412.

The guide mechanism 30 may further include a bearing fixing part 311 to which the bearing 340 is fixed.

The rotating shaft 412 may be coupled to the impeller 20 in the state of passing through the bearing 340.

According to this embodiment, since the rotating shaft 412 is coupled to the impeller 20 in the state of passing through the bearing 340, the rotating shaft 412 may be prevented from moving in a direction crossing the extension direction of the rotating shaft 412.

If the rotating shaft 412 moves in the direction crossing the extension direction of the rotating shaft 412, the impeller 20 may move in the direction crossing the extension direction of the rotating shaft 412, and thus, the impeller 20 may come into contact with the inner circumferential surface of the cover 10. In this case, noise due to friction between the impeller 20 and the cover 10 may be generated, and also, the flow of air may not be smooth during the rotation of the impeller 20.

However, according to the present invention, since the movement of the rotating shaft 412 in the direction crossing the extension direction of the rotating shaft 412 may be prevented to prevent the impeller 20 from coming into contact with the cover 10.

Figure 7:
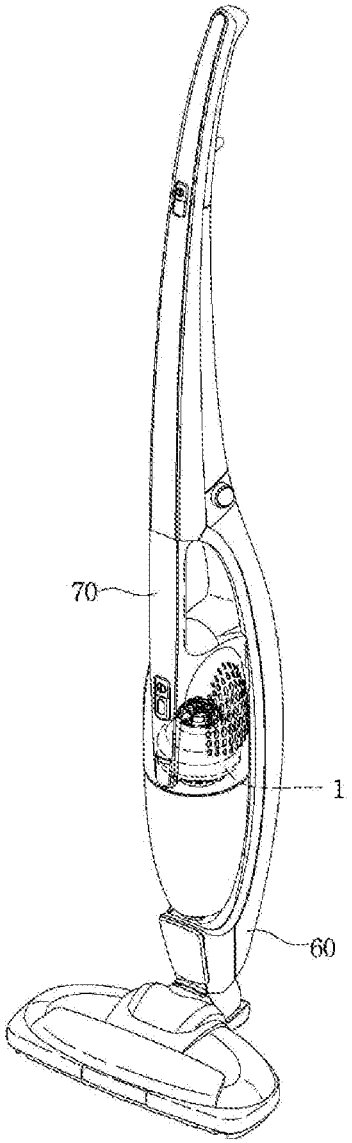
FIG. 7 is a perspective view of a vacuum cleaner including the suction unit according to the present invention.

FIG. 7 is a perspective view of a vacuum cleaner including the suction unit according to the present invention.

Referring to FIG. 7, the suction unit 1 of the present invention may be, for example, provided within a handy type cleaning unit 70.

The suction unit 1 may operate in the state in which the handy type cleaning unit 70 is separated from the stick body 60, or the suction unit may operate in the state in which the handy type cleaning unit 70 is coupled to the stick body 60.

The above-disclosed subject matter is to be considered illustrative, and not restrictive, and the appended claims are intended to cover all such modifications, enhancements, and other embodiments, which fall within the true spirit and scope of the present disclosure. Thus, the embodiment of the present invention is to be considered illustrative, and not restrictive, and the technical spirit of the present invention is not limited to the foregoing embodiment.

The invention claimed is:

1. A suction unit comprising:

a cover comprising an air inlet part that extends in an axial direction, that has a ring shape, and that defines an air flow path, the air flow path extending from an opening defined at an upper end of the air inlet part and surrounded by an inner circumferential surface of the air inlet part;

a noise reduction part disposed on the cover and spaced apart from the air inlet part in the axial direction, the noise reduction part comprising a first rib having a first ring shape, a second rib that has a second ring shape and that is disposed inside the first rib, and a third rib that radially extends between the first rib and the second rib and that is in direct contact with an inner circumferential surface of the first rib and an outer circumferential surface of the second rib;

an impeller disposed inside of the cover and the air inlet part and configured to cause air to flow into the air flow path via the noise reduction part, the impeller extending to the opening of the air inlet part in the axial direction and radially facing the inner circumferential surface of the air inlet part;

a motor comprising a rotating shaft that is connected to the impeller and that extends through the impeller in the axial direction toward the noise reduction part, wherein the noise reduction part protrudes outward of the air inlet part in the axial direction;

a guide mechanism comprising a cylindrical guide body configured to guide air discharged from an outlet of the impeller;

a shaft coupling part that defines a groove configured to receive an end portion of the rotating shaft and that couples the rotating shaft to the impeller; and connection ribs that radially extend across the air flow path from the air inlet part to the first rib of the noise reduction part, that are in direct contact with the air inlet part and the first rib of the noise reduction part, and that are spaced apart from one another along the air inlet part, wherein a bottom surface of the first rib is located vertically above the upper end of the air inlet part in the axial direction, and each of the connection ribs extends from the first rib to the upper end of the air inlet part in the axial direction, and wherein the first rib, the second rib, and the third rib are disposed on one plane that is spaced apart from the upper end of the air inlet part in the axial direction, that extends in a radial direction perpendicular to the axial direction, and that passes through a top surface of each of the first rib, the second rib, and the third rib.

2. The suction unit of claim 1, wherein the air flow path is defined radially between the noise reduction part and the air inlet part.

3. The suction unit of claim 1, wherein the noise reduction part is configured to divide air flow into a plurality of air flow paths.

4. The suction unit of claim 1, wherein the noise reduction part has an outer diameter less than an inner diameter of the air inlet part.

5. The suction unit of claim 1, wherein the noise reduction part defines an upper air flow path between the first rib and the second rib, the second rib defining an inner air passage surrounded by the upper air flow path.

6. The suction unit of claim 5, wherein the air flow path is defined between the first rib and the air inlet part.

7. The suction unit of claim 5, wherein the first rib is disposed between the upper air flow path and the air flow path.

8. The suction unit of claim 5, wherein the third rib extends across the upper air flow path and connects to the first rib at a position corresponding to one of the connection ribs.

9. The suction unit of claim 1, wherein the impeller comprises:

a shaft through-part through which the rotating shaft passes; and an accommodation part that defines an opening configured to accommodate the shaft coupling part.

10. The suction unit of claim 9, wherein the rotating shaft comprises a coupling end to which the shaft coupling part is coupled, and the coupling end is disposed in the accommodation part in a state of passing through the shaft coupling part.

11. The suction unit of claim 10, wherein the coupling end comprises a screw thread, and the shaft coupling part comprises a screw thread to which the screw thread of the coupling end is coupled.

12. The suction unit of claim 9, wherein the shaft coupling part is spaced apart from an inlet of the accommodation part toward the rotating shaft in a state in which the shaft coupling part is coupled to the rotating shaft in the accommodation part.

13. The suction unit of claim 9, wherein the accommodation part has an inner diameter greater than that of the shaft through-part, and the shaft coupling part comes into contact with a stepped surface between the accommodation part and the shaft through-part in a state in which the shaft coupling part is coupled to the rotating shaft.

14. The suction unit of claim 1, wherein the rotating shaft passes through the guide mechanism, and a bearing through which the rotating shaft passes is disposed on the guide mechanism.

15. The suction unit of claim 14, wherein the rotating shaft is connected to the impeller after passing through the bearing.

16. The suction unit of claim 1, wherein the impeller comprises a hub and a plurality of blades disposed on the hub, the guide mechanism comprises a guide body and a plurality of vanes disposed to be spaced apart from each other in a circumferential direction on an outer circumferential surface of the guide body, and the hub has a maximum diameter greater than an outer diameter of the guide body.

17. The suction unit of claim 1, wherein the third rib of the noise reduction part is one of third ribs that are arranged around the second rib, that extend radially outward from the second rib to the first rib, and that are connected to coupling portions of the first rib coupled to the connection ribs, and wherein each of the third ribs extends from one of the coupling portions connected to one of the connection ribs to the second rib.

18. The suction unit of claim 1, wherein the impeller comprises:

a hub that extends toward the noise reduction part in the axial direction, an outer diameter of the hub decreasing as the hub extends toward the noise reduction part; and a plurality of blades that are disposed on an outer circumferential surface of the hub, each of the plurality of blades extending in the axial direction and along the outer circumferential surface of the hub, and wherein a radial distance between the rotating shaft and a radial end of each of the plurality of blades decreases as the hub extends toward the noise reduction part.

19. A suction unit comprising:

a cover comprising an air inlet part that defines an air flow path, the air flow path extending from an opening defined at an upper end of the air inlet part and surrounded by an inner circumferential surface of the air inlet part;

a noise reduction part disposed on the cover and spaced apart from the air inlet part in an axial direction, the noise reduction part comprising a first rib having a first ring shape, a second rib disposed inside the first rib, and a third rib that radially extends between the first rib and the second rib and that is in direct contact with an inner circumferential surface of the first rib and an outer circumferential surface of the second rib;

an impeller disposed inside of the cover and the air inlet part and configured to cause air to flow into the air flow path via the noise reduction part, the impeller extending to the opening of the air inlet part in the axial direction and radially facing the inner circumferential surface of the air inlet part, the impeller comprising:

a hub that extends toward the noise reduction part in the axial direction, an outer diameter of the hub decreasing as the hub extends toward the noise reduction part, and a plurality of blades that are disposed on an outer circumferential surface of the hub, each of the plurality of blades extending in the axial direction and along the outer circumferential surface of the hub;

a motor comprising a rotating shaft that is connected to the impeller and that extends through the impeller in the axial direction toward the noise reduction part, wherein the noise reduction part protrudes outward of the air inlet part in the axial direction;

a guide mechanism comprising a cylindrical guide body configured to guide air discharged from an outlet of the impeller;

a shaft coupling part that defines a groove configured to receive an end portion of the rotating shaft and that couples the rotating shaft to the impeller; and connection ribs that extend across the air flow path from the air inlet part to the first rib of the noise reduction part, that connect the air inlet part to the first rib of the noise reduction part, and that are spaced apart from one another along the air inlet part, wherein a radial distance between the rotating shaft and a radial end of each of the plurality of blades decreases as the hub extends toward the noise reduction part, and wherein the first rib, the second rib, and the third rib are disposed on one plane that is spaced apart from the upper end of the air inlet part in the axial direction, that extends in a radial direction perpendicular to the axial direction, and that passes through a top surface of each of the first rib, the second rib, and the third rib.

* * * * *